US007437884B2

(12) United States Patent
Otake et al.

(10) Patent No.: US 7,437,884 B2
(45) Date of Patent: Oct. 21, 2008

(54) AIR CONDITIONER

(75) Inventors: Masahisa Otake, Gunma (JP); Hiroshi Mukaiyama, Gunma (JP); Ichiro Kamimura, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 152 days.

(21) Appl. No.: 11/371,285

(22) Filed: Mar. 9, 2006

(65) Prior Publication Data

US 2006/0201183 A1 Sep. 14, 2006

(30) Foreign Application Priority Data

Mar. 9, 2005 (JP) ..... 2005-066337

(51) Int. Cl.
*F25D 23/00* (2006.01)

(52) U.S. Cl. ..... 62/271; 62/94

(58) Field of Classification Search ..... 62/94, 62/271, 274, 375, 333

See application file for complete search history.

(56) References Cited

U.S. PATENT DOCUMENTS 5,613,372 A * 3/1997 Beal et al. ..... 62/434
6,442,951 B1 * 9/2002 Maeda et al. ..... 62/94
6,557,266 B2 * 5/2003 Griffin ..... 34/168

FOREIGN PATENT DOCUMENTS

JP 2004-85096 A 3/2004

* cited by examiner

*Primary Examiner*—Melvin Jones
(74) *Attorney, Agent, or Firm*—McDermott Will & Emery LLP

(57) ABSTRACT

An object is to provide an air conditioner in which a desiccant air conditioner is combined with a refrigerating device to cool an indoor by a refrigeration cycle including a compressor and the like and in which a drop of energy efficiency is suppressed. An air conditioner 200 includes a desiccant air conditioner 220 and a refrigerating device 210 which cools the indoor by a usual refrigeration cycle, this refrigerating device 210 has an auxiliary heat exchanger 17 between an outlet side of a heater 12 and an inlet side of an expansion valve 14, and this auxiliary heat exchanger 17 is disposed externally from an exhaust air passage 4 and a supply air passage 3.

7 Claims, 5 Drawing Sheets

AIR CONDITIONER

BACKGROUND OF THE INVENTION

1. Field of the Invention

The present invention relates to an air conditioner in which a desiccant air conditioner is combined with a refrigerating device having a refrigeration cycle provided with a compressor and the like.

2. Description of the Related Art

Heretofore, an air conditioner is known in which a desiccant air conditioner is combined with a refrigeration cycle provided with a compressor and the like. For example, in Japanese Patent Application Laid-Open No. 2004-85096, there is disclosed an air conditioner constituted by combining the desiccant air conditioner, a device involving exhaust heat from a gas engine or the like, and a refrigerating device having the refrigeration cycle. This air conditioner is constituted as shown in FIG. 5. It is to be noted that in FIG. 5, a solid-line arrow shows a flow of outside air (hereinafter referred to as supply air) taken into a room from the outside, and a broken-line arrow shows indoor air (hereinafter referred to as indoor exhaust air) discharged from the room to the outside.

As shown in FIG. 5, an air conditioner 100 includes: a desiccant air conditioner 120 including a supply air passage 3 which introduces outside air into a room 2 and an exhaust air passage 4 which discharges indoor air; and a refrigerating device 110. Moreover, the supply air passage 3 is disposed adjacent to the exhaust air passage 4.

The refrigerating device 110 includes a compressor 65, a driving source 63 as a driving element of the compressor 65, a heater 12, an expansion valve 14, an evaporator 15, and an exhaust heat heater 64 which utilizes exhaust heat of the driving source 63. They are successively connected to one another to form the refrigeration cycle.

In the supply air passage 3, there are successively arranged a supply air passage section of a rotary dehumidifier 5, a supply air passage section of a rotary sensible heat exchanger 6, and the evaporator 15 from the outdoors toward the interior of the room 2. On the other hand, in the exhaust air passage 4, there are successively arranged a eveporative cooler 8, an exhaust air passage section of the rotary sensible heat exchanger 6, the heater 12, the exhaust heat heater 64, and an exhaust air passage section of the rotary dehumidifier 5 from the room 2 toward the outdoors.

As shown in FIG. 5, the rotary dehumidifier 5 is disposed ranging from the supply air passage 3 to the adjacent exhaust air passage 4. Accordingly, the supply air passage section is disposed on the side of the supply air passage 3, and the exhaust air passage section is disposed on the side of the exhaust air passage 4 as described above. This rotary dehumidifier 5 adsorbs moisture from passing supply air to dehumidify the supply air passage section in the supply air passage 3. In the exhaust air passage section of the exhaust air passage 4, an adsorbing section which has adsorbed the moisture is heated, dried, and regenerated by passing high-temperature indoor exhaust air heated by the heater 12 and the like.

The rotary sensible heat exchanger 6 is a rotary heat exchange rotor. Moreover, this rotary sensible heat exchanger 6 is constituted to allow supply air passing through the supply air passage section of the supply air passage 3 to exchange sensible heat with indoor exhaust air passing through the exhaust air passage section of the exhaust air passage 4.

In the evaporator 15, a refrigerant whose pressure has been reduced by the expansion valve 14 evaporates to absorb heat from its periphery, and the evaporator further cools supply air cooled by the supply air passage section of the rotary sensible heat exchanger 6.

Moreover, in the heater 12, a high-temperature high-pressure refrigerant compressed by the compressor 65 radiates heat to heat the periphery, and the heater further heats indoor exhaust air heated by the exhaust air passage section of the rotary sensible heat exchanger 6. Furthermore, after the indoor exhaust air heated by the heater 12 is further heated by the exhaust heat heater 64, indoor exhaust air reaches the exhaust air passage section of the rotary dehumidifier 5.

It is to be noted that the humidifier 8 sprays water such as city water to cool indoor exhaust air.

Next, there will be described a function of the air conditioner 100 constituted as described above. First, outdoor air, that is, supply air is conveyed into the rotary dehumidifier 5 via the supply air passage 3. Moreover, supply air is dehumidified in the supply air passage section of the rotary dehumidifier 5. At this time, heat of adsorption is generated in this supply air passage section.

Furthermore, after supply air dehumidified as described above is cooled by indoor exhaust air flowing into the exhaust air passage section of the rotary sensible heat exchanger in the supply air passage section of the rotary sensible heat exchanger 6, supply air is further cooled by the evaporator 15, and supplied into the room 2.

On the other hand, indoor exhaust air is first humidified in the eveporative cooler 8, and cooled by latent heat of evaporation of water. Thereafter, indoor exhaust air is heated by heat of supply air flowing into the supply air passage section of the rotary sensible heat exchanger 6 in the exhaust air passage section of the rotary sensible heat exchanger 6. Moreover, after indoor exhaust air is heated in the heater 12, indoor exhaust air is further heated by the exhaust heat heater 64. Thereafter, indoor exhaust air heats and dries an adsorbent in the exhaust air passage section of the rotary dehumidifier 5, and indoor exhaust air itself is humidified and discharged to the outdoors.

Here, there will be described an enthalpy and pressure graph of the refrigeration cycle in the refrigerating device 110 of the air conditioner 100 with reference to FIG. 2. In FIG. 2, cycle graphs shown by broken lines, that is, (1), (2), (6), and (5) show refrigeration cycle graphs in this case. In this case, the refrigerant circulates in order of (1) suction of the compressor 65, (2) discharge of the compressor 65, (6) an outlet of the heater 12, (5) an outlet of the expansion valve 14 corresponding to an inlet of the evaporator 15, and (1) suction of the compressor 65 to thereby form the refrigeration cycle In the air conditioner 100 described above, since indoor exhaust air heated by the heater 12 is further heated by the exhaust heat heater 64, temperature rises in the other half of the rotary dehumidifier 5 in the exhaust air passage 4. Therefore, temperature of supply air passing through the supply air passage section of the rotary dehumidifier 5 rises. Moreover, temperature in the rotary sensible heat exchanger 6 also rises. Therefore, this air conditioner 100 is constituted so that indoor exhaust air is cooled by the eveporative cooler 8 to lower the temperature of the rotary sensible heat exchanger 6.

However, the eveporative cooler 8 is required for the above-described constitution. Even if such eveporative cooler 8 is disposed, the temperature of the refrigerant discharged from the heater 12 also becomes high because the temperature of indoor exhaust air flowing into the heater 12 is high. As a result, a cooling capacity (between (5) and (1) in the cycle graphs shown by the broken lines in FIG. 2) in the evaporator 15 becomes very small. Accordingly, there is a problem that the cooling capacity of supply air into the room degrades, and an energy efficiency in the whole air conditioner lowers.

SUMMARY OF THE INVENTION

The present invention has been developed in view of such problems of a conventional technology, and an object is to provide an air conditioner capable of inhibiting a drop of an energy efficiency in a case where a desiccant air conditioner is combined with a refrigerating device for cooling the room by a refrigeration cycle including a compressor and the like.

In a first aspect of the present invention, an air conditioner comprises: a supply air passage which introduces outside air into a room; an exhaust air passage which discharges air from the room; a dehumidifier having adsorbing means capable of adsorbing moisture in air, a part of the dehumidifier being disposed in the supply air passage, a part or all of a remaining part of the dehumidifier being disposed in the exhaust air passage, the adsorbing means adsorbing moisture in supply air in the supply air passage, the adsorbing means being dried by exhaust air in the exhaust air passage; a refrigerating device provided with a refrigeration cycle including a compressor, a heater which is disposed on a discharge side of the compressor and which is disposed so that a refrigerant compressed by the compressor rejects heat to heat exhaust air in the exhaust air passage, an expansion valve into which the refrigerant flows that has rejects heat in the heater, and an evaporator which is disposed on an outlet side of the expansion valve and which is disposed so that the refrigerant whose pressure has been reduced by the expansion valve evaporates to cool supply air in the supply air passage; and a sensible heat exchanger which allows supply air dehumidified by the rotary dehumidifier to exchange sensible heat with exhaust air before flowing into the heater. The refrigerating device has a heat exchanger between an outlet side of the heater and an inlet side of the expansion valve, and the heat exchanger is disposed externally from the exhaust air passage and the supply air passage.

In a second aspect of the present invention, the air conditioner of the first aspect further comprises: a blower device disposed in the vicinity of the heat exchanger and a control device for driving or stopping said blower device or for controlling a air flow rate of the blower device. The control device drives or stops the blower device or controls the air flow rate of the blower device based on at least one of detected values of a room temperature sensor which detects temperature in the room, a humidity sensor which detects humidity in the room, a refrigerant temperature sensor which detects temperature of the refrigerant in an outlet of the heat exchanger, a first exhaust air temperature sensor which detects temperature of exhaust air between the sensible heat exchanger and the heater in the exhaust air passage, and a second exhaust air temperature sensor which detects temperature of exhaust air between the heater and the dehumidifier in the exhaust air passage.

In a third aspect of the present invention, the air conditioner of the first aspect further comprises: a water cooled heat exchanger for cooling the refrigerant with water.

In a fourth aspect of the present invention, an air conditioner comprises: a supply air passage which introduces outside air into a room; an exhaust air passage which discharges air from the room; a dehumidifier having adsorbing means capable of adsorbing moisture in air, a part of the dehumidifier being disposed in the supply air passage, a part or all of a remaining part of the dehumidifier being disposed in the exhaust air passage, the adsorbing means adsorbing supply air in the supply air passage, the adsorbing means being dried by exhaust air in the exhaust air passage; a refrigerating device provided with a refrigeration cycle including a compressor, a heater which is disposed on a discharge side of the compressor and which is disposed so that a refrigerant compressed by the compressor radiates heat to heat exhaust air in the exhaust air passage, an expansion valve into which the refrigerant flows that has radiated heat in the heater, and an evaporator which is disposed on an outlet side of the expansion valve and which is disposed so that the refrigerant whose pressure has been reduced by the expansion valve evaporates to cool supply air in the supply air passage; and a sensible heat exchanger which allows supply air dehumidified by the dehumidifier to exchange sensible heat with exhaust air before flowing into the heater. The refrigerating device has a heat exchanger between an outlet side of the heater and an inlet side of the expansion valve, and the heat exchanger is disposed on an outdoor side of the dehumidifier in the exhaust air passage.

In a fifth aspect of the present invention, the air conditioner of any one of the first to fourth aspects further comprises: a circulation passage capable of circulating air in the room to the supply air passage. The supply air passage includes: outside air introduced amount control means capable of controlling an amount of outside air to be introduced into the supply air passage; and circulation air amount control means capable of controlling an amount of air to be circulated from the circulation passage to the supply air passage. A connecting portion of the circulation passage to the supply air passage is disposed between the outside air introduced amount control means and the dehumidifier.

In a sixth aspect of the present invention, in the air conditioner of any one of the first to fifth aspects, carbon dioxide is used as the refrigerant of the refrigerating device.

According to the present invention, in the air conditioner in which a desiccant air conditioner is combined with the refrigerating device having the refrigeration cycle provided with the compressor and the like, a drop of a cooling capacity in the refrigerating device is suppressed, and an energy efficiency of the air conditioner can be improved.

DESCRIPTION OF THE PREFERRED EMBODIMENT

There will be described a preferable embodiment of an air conditioner in the present invention in detail with reference to the drawings.

Embodiment 1

Figure 1:
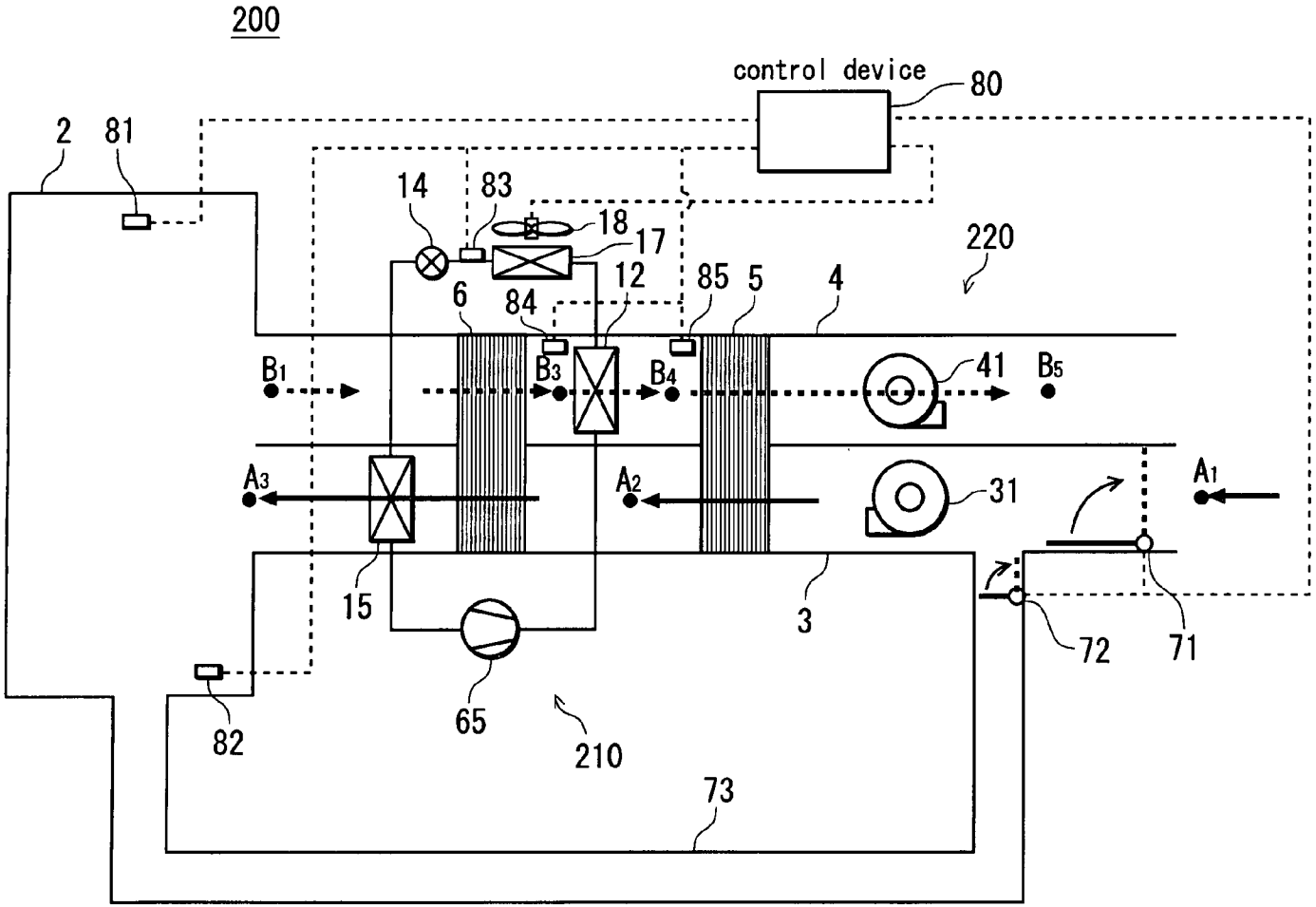
FIG. 1 is a schematic explanatory view of an air conditioner in a first embodiment of the present invention.

One embodiment of the present invention will be described in detail with reference to FIG. 1. FIG. 1 is a constitution explanatory view of an air conditioner 200 in the embodiment of the present invention. It is to be noted that in the present embodiment, components denoted with the same reference numeral as those of elements of a conventional air conditioner 100 have the same or similar functions, and produce the same or similar effects.

The air conditioner 200 of the present embodiment includes a desiccant air conditioner 220, a refrigerating device 210, and a control device 80.

Figure 5:
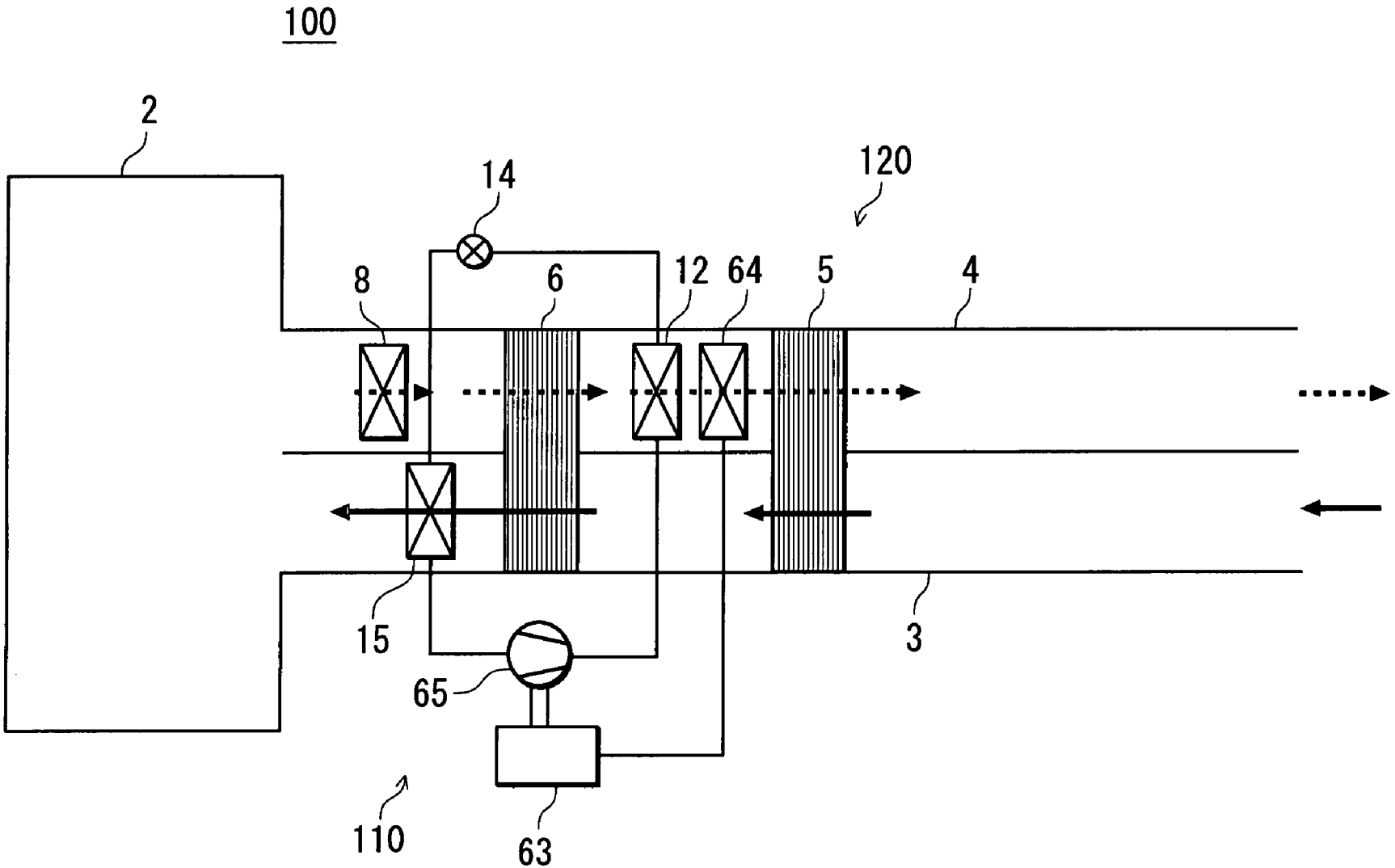
FIG. 5 is a constitution explanatory view of the air conditioner in the conventional example.

In the desiccant air conditioner 220, a supply air passage 3 is disposed adjacent to an exhaust air passage 4 in the same manner as in a desiccant air conditioner 120 of the conventional example shown in FIG. 5. In this desiccant air conditioner 220, a rotary dehumidifier 5 is disposed ranging from the supply air passage 3 to the exhaust air passage 4 on an outdoor side in the supply air passage 3 and the exhaust air passage 4. A rotary sensible heat exchanger 6 is disposed ranging from the supply air passage 3 to the exhaust air passage 4 on an indoor 2 side in the supply air passage 3 and the exhaust air passage 4. A supply air fan 31 and an exhaust air fan 41 are disposed in the vicinities of an outside air supply port of the supply air passage 3 and an exhaust port of indoor exhaust air of the exhaust air passage 4, respectively.

From an outdoor side toward the indoor 2 side in the supply air passage 3, there are successively arranged the supply air fan 31, an air supply passage section of the rotary dehumidifier 5, an air supply passage section of the rotary sensible heat exchanger 6, and an evaporator 15. On the other hand, from the indoor 2 side toward the outdoor side in the exhaust air passage 4, there are successively arranged an exhaust air passage section of the rotary sensible heat exchanger 6, a heater 12, an exhaust air passage section of the rotary dehumidifier 5, and the exhaust air fan 41.

Moreover, an outside air damper 71 is disposed on an outdoor side from the supply air fan 31 of the supply air passage 3, and there is disposed a circulation passage 73 for supplying indoor air between the supply air fan 31 and the outside air damper 71 from the indoor 2. An internal air damper 72 is disposed in the vicinity of a confluent portion between the circulation passage 73 and the supply air passage 3. As to two dampers 71, 72, as shown by a solid line in the drawing, the outside air damper 71 is opened, and the internal air damper 72 is closed during usual operation. Each of the dampers is controlled to open and close at an arbitrary angle to a position shown by a broken line in the drawing by a control device 80. Accordingly, a flow amount of air of the supply air passage 3 and the circulation passage 73 is controlled.

In the present embodiment, the rotary dehumidifier 5 is a rotary rotor in which a honeycomb-like air passage is made of a sheet-like material synthesized by impregnating a glass fiber as a base material with silica gel as moisture adsorbing means. In this manner, the rotary dehumidifier 5 is constituted to bring passing air into contact with the sheet-like material with a high efficiency. The rotary sensible heat exchanger 6 is a rotary heat exchanging rotor in which a honeycomb-like air passage is made of an aluminum plate. Moreover, this rotary sensible heat exchanger 6 is constituted to exchange sensible heat between supply air passing through the supply air passage section of the supply air passage 3 via the aluminum plate forming the honeycomb-like air passage and indoor exhaust air passing through the exhaust air passage section of the exhaust air passage 4.

The refrigerating device 210 is filled with carbon dioxide as a refrigerant. The device includes: a compressor 65 whose capability can be variably controlled by an inverter device (not shown); the heater 12 for cooling a high-pressure refrigerant discharged from this compressor 65 and for heating indoor exhaust air; an auxiliary heat exchanger 17 which is disposed in outside air, that is, externally from the supply air passage 3 and the exhaust air passage 4 to further cool the refrigerant discharged from this heater 12; a blower device 18 which is attached in the vicinity of this auxiliary heat exchanger 17 and which radiates heat of the refrigerant to outside air; an expansion valve 14 into which the refrigerant discharged from the auxiliary heat exchanger 17 flows; and the evaporator 15 in which the refrigerant passed through this expansion valve 14 evaporates and absorbs heat from its periphery to cool supply air to the indoor 2. They are successively connected via refrigerant piping to form a refrigeration cycle The control device 80 controls a rotational speed of the blower device 18, drives and stops the blower device, and further controls open degrees of the outside air damper 71 and the internal air damper 72 based on detected values of a temperature sensor 81 and a humidity sensor 82 disposed in the indoor 2, a temperature sensor 83 disposed in an outlet-side refrigerant pipe of the auxiliary heat exchanger 17, a temperature sensor 84 disposed on the indoor 2 side of the heater 12 in the exhaust air passage 4, a temperature sensor 85 installed on an outdoor side and the like.

Figure 2:
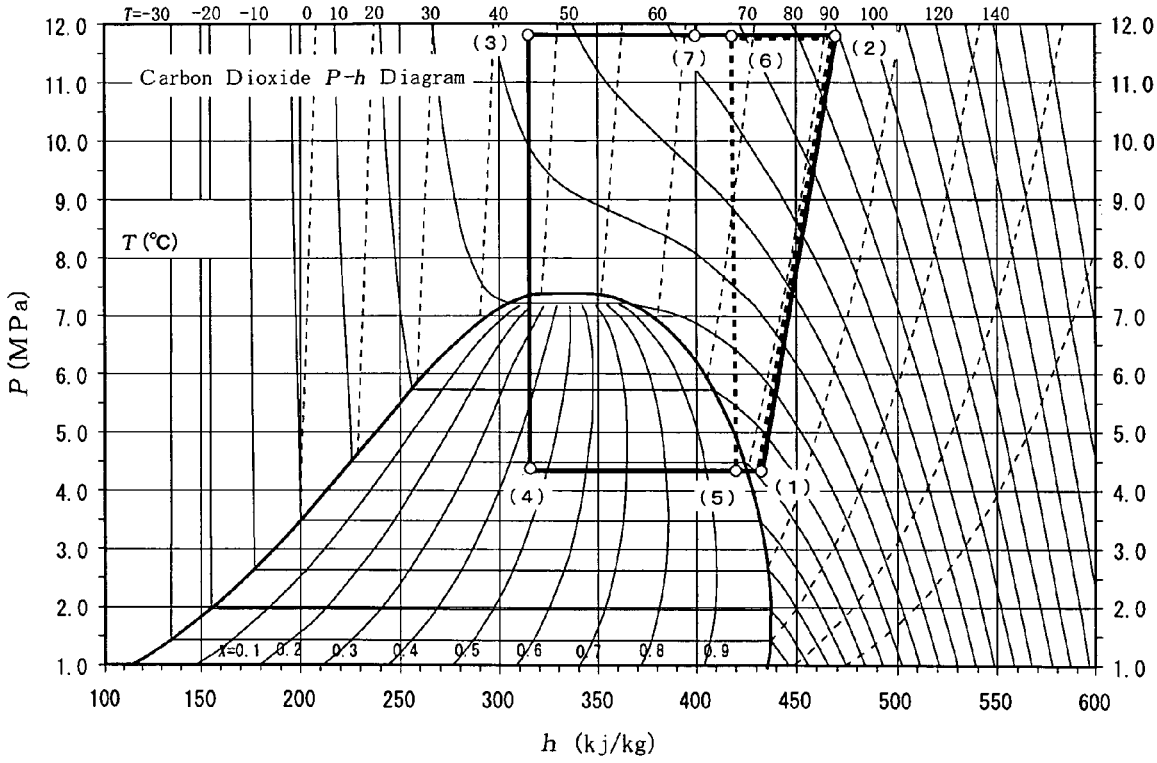
FIG. 2 is an enthalpy and pressure graph of a refrigeration cycle of a refrigerating device in an air conditioner of a conventional example and an air conditioner of the first embodiment of the present invention.

Next, there will be described a function of the air conditioner 200 constituted as described above with reference to FIGS. 1 and 2. FIG. 2 is an enthalpy and pressure graph showing a refrigeration cycle of the refrigerating device 210 in the air conditioner 200.

First, outdoor outside air (supply air) A1 (e.g., dry-bulb temperature at 32° C., relative humidity ψ=40%) is conveyed to the rotary dehumidifier 5 via the supply air passage 3. Moreover, supply air is dehumidified in the supply air passage section of the rotary dehumidifier 5. At this time, adsorption heat is generated in the supply air passage section of the rotary dehumidifier 5. As a result, supply air reaches point A2 without involving any energy change in the supply air passage section of this rotary dehumidifier 5. At this time, an air state in A2 exhibits, for example, a dry-bulb temperature at about 55 to 65° C. and a relative humidity ψ=about 4%.

Moreover, supply air A2 is cooled into, for example, a dry-bulb temperature at about 30° C. and a relative humidity ψ=about 45% by indoor exhaust air flowing into the exhaust air passage section of the rotary sensible heat exchanger 6 in a state (e.g., dry-bulb temperature at about 26° C., relative humidity ψ=about 60%) of a point B1 of the exhaust air passage 4 in the supply air passage section of the rotary sensible heat exchanger 6. Furthermore, air is cooled by the evaporator 15 into a state (e.g., dry-bulb temperature at about 14 to 18° C., relative humidity ψ=about 75%) of A3, and air is supplied to the indoor 2 to condition air of this indoor 2.

On the other hand, indoor exhaust air B1 (e.g., dry-bulb temperature at 26° C., relative humidity ψ=60%) is heated into a point B3 (e.g., dry-bulb temperature at about 50 to 55° C., relative humidity ψ=about 42%) by heat of supply air flowing into the supply air passage section of the rotary sensible heat exchanger 6 in a state (e.g., dry-bulb temperature at about 55 to 65° C., relative humidity ψ=about 4%) of the point A2 in the exhaust air passage section of the rotary sensible heat exchanger 6.

Moreover, indoor exhaust air of this point B3 is further heated to a point B4 (e.g., dry-bulb temperature at about 70 to 80° C., relative humidity ψ=about 5%) in the heater 12. In the point B4, indoor exhaust air heats and dries an adsorbent of the rotary dehumidifier 5 in the exhaust air passage section of the rotary dehumidifier 5, indoor exhaust air itself is humidified and cooled into a point B5 (e.g., dry-bulb temperature at about 38 to 42° C., relative humidity ψ=about 50%), and indoor exhaust air is discharged to the outdoors. It is to be noted that the control device 80 may control the rotational speed of the compressor 65 and the open degree of the expansion valve 14 so that the point B4 reaches a predetermined temperature, that is, the detected value of the temperature sensor 85 indicates temperature (e.g., 80° C.) required for drying in the rotary dehumidifier 5.

Here, there will be described an enthalpy and pressure graph of the refrigeration cycle in the refrigerating device 210 of the air conditioner 200 with reference to FIG. 2. In FIG. 2, cycle graphs shown by solid lines, that is, (1), (2), (7), (3), and (4) show refrigeration cycle graphs of the refrigerating device 210 in this case. In the refrigerating device 210, the refrigerant circulates in order of (1) suction of the compressor 65, (2) discharge of the compressor 65, (7) an outlet of the heater 12 corresponding to an inlet of the auxiliary heat exchanger 17, (3) an outlet of the auxiliary heat exchanger 17, (4) an outlet of the expansion valve 14 corresponding to an inlet of the evaporator 15, and (1) suction of the compressor 65 to form the refrigeration cycle According to the above-described constitution of the refrigerating device 210 of the air conditioner 200 in the present embodiment, the refrigerant flows into the heater 12 at, for example, inlet temperature of about 110° C., and flows out at outlet temperature of about 65° C. On the other hand, indoor exhaust air flowing through the exhaust air passage 4 flows into the heater 12 at, for example, inlet temperature of about 50° C., and flows out at outlet temperature which is higher than that of the refrigerant, for example, at about 80° C. Therefore, when high-temperature exhaust air flows into the exhaust air passage section of the rotary dehumidifier 5 on the exhaust air passage 4 side, the rotary dehumidifier 5 can be dried and regenerated with a high efficiency. In the present embodiment, since carbon dioxide is used as the refrigerant, in a high-pressure side of the refrigeration cycle such as, the heater 12, the refrigerant is brought into a supercritical state, and indoor exhaust air can be heated at high temperature with high efficiency. However, in this case, the outlet temperature of the refrigerant in the heater 12 is about 65° C. Even if the refrigerant is introduced into the evaporator 15 at such temperature, a cooling capacity in the evaporator 15 degrades as described above in a conventional example.

To solve the problem, in the refrigerating device 210 of the present embodiment, the auxiliary heat exchanger 17 is disposed in a subsequent stage portion of the heater 12 in the refrigeration cycle, and this auxiliary heat exchanger 17 is constituted to reject heat to outside air. The refrigerant is cooled by this auxiliary heat exchanger 17 before flowing into the expansion valve 14 and evaporator 15. Therefore, as shown in (4) to (1) of FIG. 2, a cooling performance of the evaporator 15 can be largely improved. Accordingly, as in the conventional example, supply air flowing into the indoor 2 can be sufficiently cooled without disposing any evaporative cooler (cooling means) on a downstream side of the evaporator 15 in the supply air passage 3 or on the indoor 2 side of the rotary sensible heat exchanger 6 in the exhaust air passage 4.

It is to be noted that an amount of heat to be radiated in the auxiliary heat exchanger 17 can be controlled by an amount of air in the blower device 18 disposed in the vicinity of this auxiliary heat exchanger 17. The rotational speed, and driving and stopping of the blower device 18 are controlled by the control device 80 based on the detected values of the temperature sensor 81 and the humidity sensor 82, so-called cooling loads, or the detected values of the respective temperature sensors 83, 84, and 85. In a case where the detected value is higher than a predetermined value (e.g., the detected value of the temperature sensor 81 is 32° C. or more), when the rotational speed of the blower device 18 is raised by the control device 80, the amount of heat to be radiated in the auxiliary heat exchanger 17 is increased. In a case where the detected value is lower than the predetermined temperature, when the blower device 18 is stopped or the rotational speed is lowered by the control device 80, the amount of heat to be radiated in the auxiliary heat exchanger 17 is reduced. Since the amount of heat to be radiated in the auxiliary heat exchanger 17 is controlled in this manner, the cooling capacity in the evaporator 15 can be maintained to be high, and the energy efficiency of the air conditioner 200 can be improved.

Additionally, in the air conditioner 200, the outside air damper 71 and the internal air damper 72 of the desiccant air conditioner 220 are positioned as shown by solid lines in FIG. 1 during usual operation as described above. When supply air into the indoor 2 is all outside air in this manner, a problem of an insufficient dehumidifying capability or an excessive cooling capacity sometimes occurs with a change of temperature or humidity of outside air. However, since the air conditioner 200 of the present embodiment includes the above-described constitution, a direction to close the outside air damper 71 and a direction to open the internal air damper 72 are controlled by the control device 80 depending on conditions of temperature and humidity of outside air. Accordingly, an amount of outside air to be taken in is adjusted especially in a case where outside air temperature or humidity is high or low. In consequence, the indoor 2 can be air-conditioned with a satisfactory efficiency.

Embodiment 2

Figure 3:
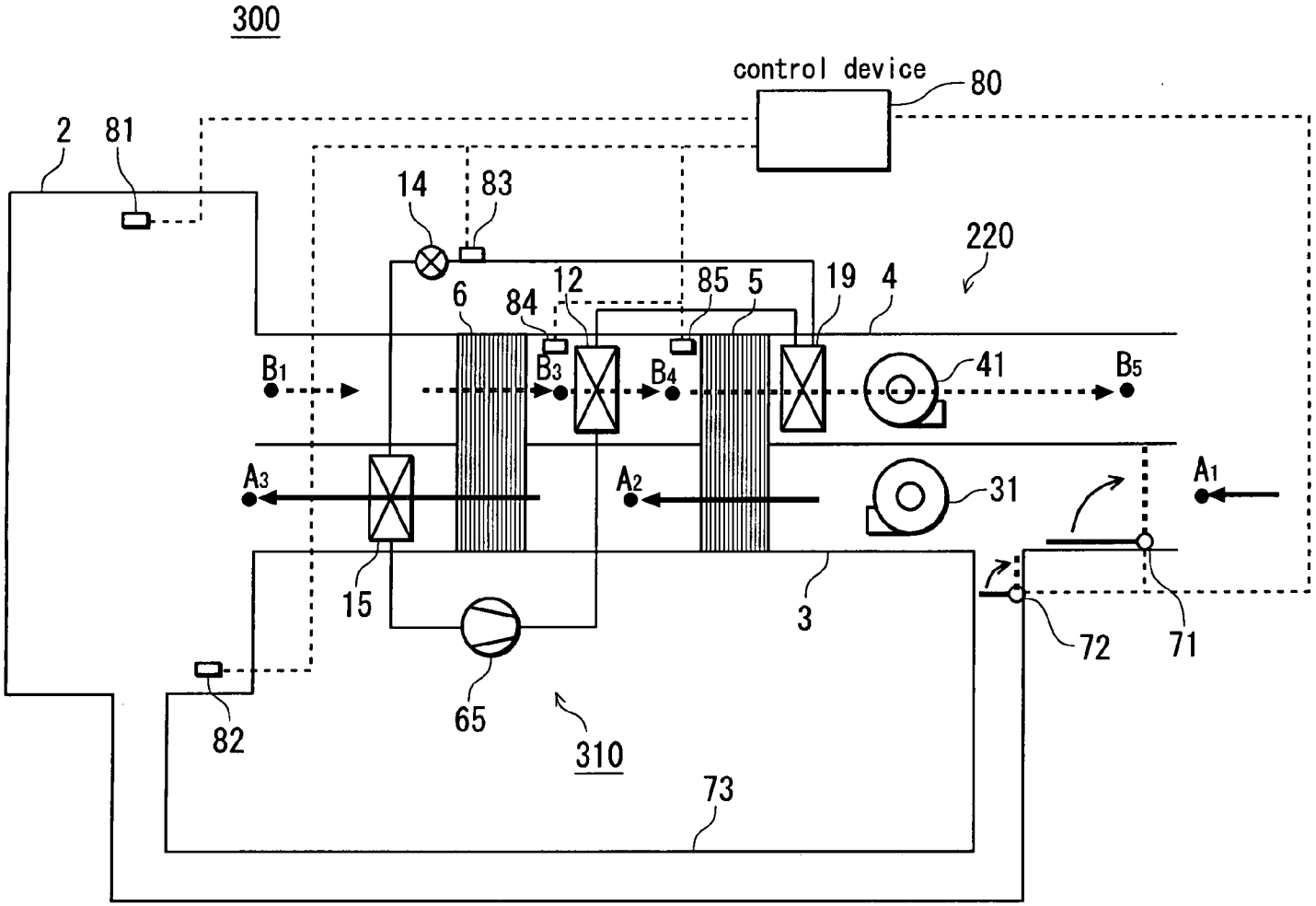
FIG. 3 is a constitution explanatory view of an air conditioner in another embodiment of the present invention.

Next, another embodiment of the air conditioner of the present invention will be described with reference to FIG. 3. FIG. 3 is a constitution explanatory view of an air conditioner 300 in this case. It is to be noted that in the present embodiment, components denoted with the same reference numerals as those of elements in the air conditioners 100, 200 have the same or similar functions and produce the same or similar effects. The air conditioner 300 of the present embodiment is different from that of Embodiment 1 in that the auxiliary heat exchanger 17 and the blower device 18 are not disposed, and a refrigerating device 310 includes an auxiliary heat exchanger 19.

The auxiliary heat exchanger 19 is disposed on an outdoor side of an exhaust air passage section of a rotary dehumidifier 5 in an exhaust air passage 4, and connected between an outlet side of a heater 12 and an inlet side of an expansion valve 14 in the refrigerating device 310 by a refrigerant pipe. Moreover, the auxiliary heat exchanger 19 performs a function similar to that of the auxiliary heat exchanger 17. It is to be noted that after indoor exhaust air is heated by the heater 12, indoor exhaust air heats and regenerates the rotary dehumidifier 5, and is cooled. Accordingly, the refrigerant of the refrigerating device 310 is cooled in the auxiliary heat exchanger 19.

As described above, according to the present embodiment, the blower device 18 is not required, and cost reduction is possible. In this case, a cooling capacity in an evaporator 15 sometimes degrades as compared with the constitution of Embodiment 1. However, needless to say, the air conditioner 300 of the present embodiment becomes more effective depending on use states or conditions.

Embodiment 3

Figure 4:
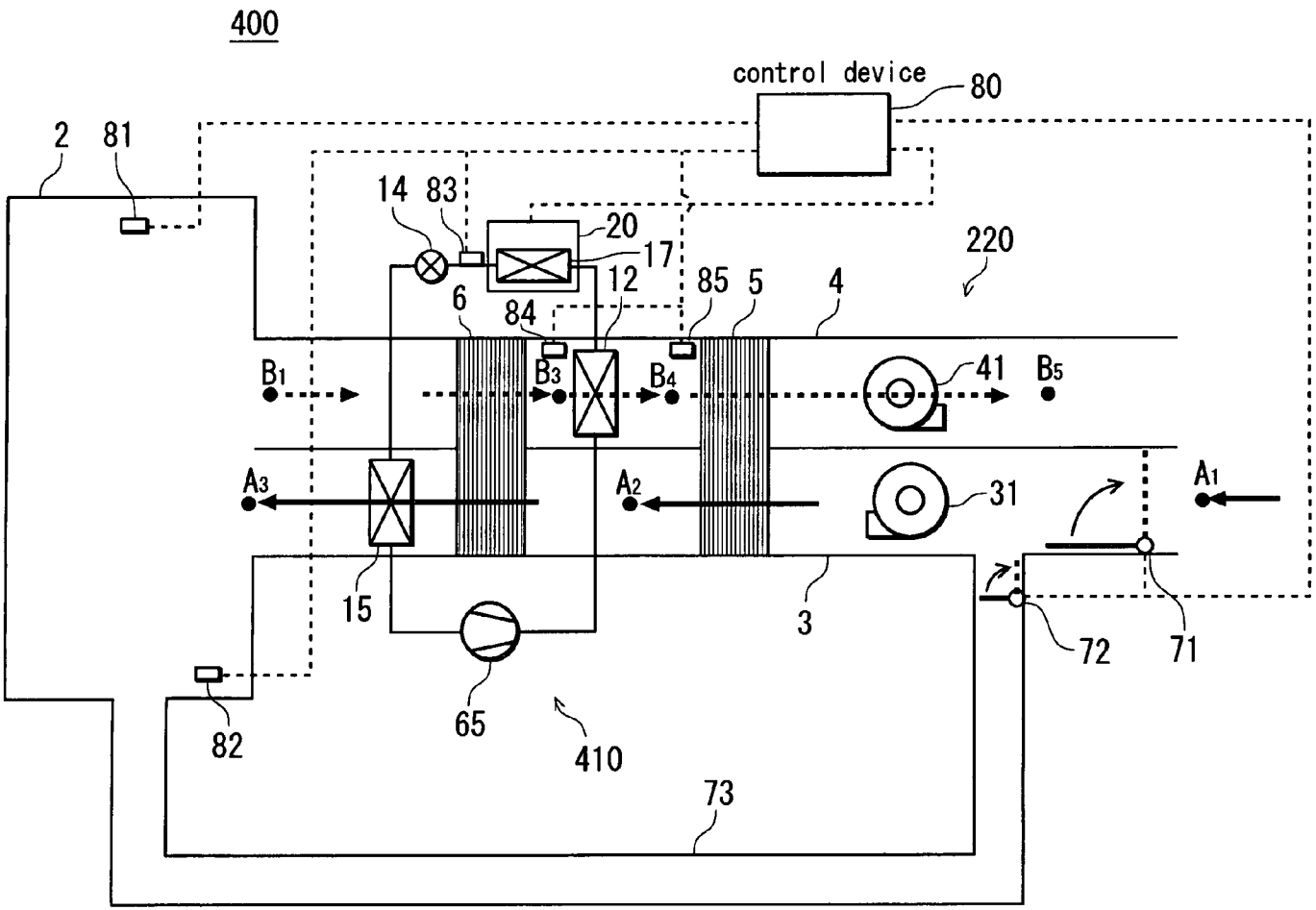
FIG. 4 is a constitution explanatory view of an air conditioner in still another embodiment of the present invention.

Next, still another embodiment of the air conditioner of the present invention will be described with reference to FIG. 4. FIG. 4 is a constitution explanatory view of an air conditioner 400 in this case. It is to be noted that in the present embodiment, components denoted with the same reference numerals as those of elements in the air conditioner 200 of Embodiment 1 have the same or similar functions and produce the same or similar effects. The air conditioner 400 of the present embodiment is different from that of Embodiment 1 in that the blower device 18 is not disposed, and a refrigerating device 410 includes a water cooled heat exchanger 20.

The water cooled heat exchanger 20 is like a water storage tank, an auxiliary heat exchanger 17 is disposed in the water cooled heat exchanger, and water is stored in the water cooled heat exchanger 20 by a water pipe (not shown). Accordingly, water can be used as a heat source of the auxiliary heat exchanger 17 to increase an amount of heat to be radiated in the auxiliary heat exchanger 17, and a cooling capacity of an evaporator 15 can be further improved. It is to be noted that the water cooled heat exchanger 20 is not limited to the exchanger which stores water as the heat source of the auxiliary heat exchanger 17, and a structure for directly spraying water to the auxiliary heat exchanger 17 is applicable to the water cooled heat exchanger. Furthermore, there is usable a double tube type heat exchanger for convecting water, a plate and frame type heat exchanger, a plate fin and tube type heat exchanger, a shell and tube type heat exchanger, a contact tube connecting type heat exchanger or the like.

The present invention has been described above in accordance with the above embodiments, but the present invention is not limited to them, and various modifications are possible. For example, in the above embodiments, a carbon dioxide refrigerant is introduced in a refrigerant circuit, but the present invention is not limited to the embodiments, and another fluorocarbon-based refrigerant or the like may be applied. The expansion valve 14 of each embodiment may be replaced with a capillary tube if necessary.

Moreover, even in each embodiment, the eveporative cooler 8 may be applied to further cool indoor exhaust air in the same manner as in the air conditioner 100 of the conventional example.

What is claimed is:

1. An air conditioner comprising:

a supply air passage which introduces outside air into a room; an exhaust air passage which discharges air from the room;

a dehumidifier having adsorbing means capable of adsorbing moisture in air, a part of the dehumidifier being disposed in the supply air passage, a part or all of a remaining part of the dehumidifier being disposed in the exhaust air passage, the adsorbing means adsorbing moisture in supply air in the supply air passage, the adsorbing means being dried by exhaust air in the exhaust air passage; a refrigerating device provided with a refrigeration cycle including: a compressor; a heater which is disposed on a discharge side of the compressor and which is disposed so that a refrigerant compressed by the compressor radiates heat to heat exhaust air in the exhaust air passage;

an expansion valve into which the refrigerant flows that has radiated heat in the heater; and an evaporator which is disposed on an outlet side of the expansion valve and which is disposed so that the refrigerant whose pressure has been lowered by the expansion valve evaporates to cool supply air in the supply air passage; and a sensible heat exchanger which allows supply air dehumidified by the rotary dehumidifier to exchange sensible heat with exhaust air before flowing into the heater, the refrigerating device having a heat exchanger between an outlet side of the heater and an inlet side of the expansion valve, the heat exchanger being disposed externally from the exhaust air passage and the supply air passage.

2. The air conditioner according to claim 1, further comprising:

a blower device disposed in the vicinity of the heat exchanger, a control device for driving or stopping said blower device or for controlling a air flow rate of the blower device, the control device driving or stopping the blower device or controlling the air flow rate of the blower device based on at least one of detected values of a room temperature sensor which detects temperature in the room, a humidity sensor which detects humidity in the room, a refrigerant temperature sensor which detects temperature of the refrigerant in an outlet of the heat exchanger, a first exhaust air temperature sensor which detects temperature of exhaust air between the sensible heat exchanger and the heater in the exhaust air passage, and a second exhaust air temperature sensor which detects temperature of exhaust air between the heater and the dehumidifier in the exhaust air passage.

3. The air conditioner according to claim 1, further comprising: a water cooled heat exchanger for cooling the heat exchanger with water.

4. An air conditioner comprising:

a supply air passage which introduces outside air into a room;

an exhaust air passage which discharges air from the room;

a dehumidifier having adsorbing means capable of adsorbing moisture in air, a part of the dehumidifier being disposed in the supply air passage, a part or all of a remaining part of the dehumidifier being disposed in the exhaust air passage, the adsorbing means adsorbing moisture in supply air in the supply air passage, the adsorbing means being dried by exhaust air in the exhaust air passage;

a refrigerating device provided with a refrigeration cycle including: a compressor; a heater which is disposed on a discharge side of the compressor and which is disposed so that a refrigerant compressed by the compressor radiates heat to heat exhaust air in the exhaust air passage; an expansion valve into which the refrigerant flows that has radiated heat in the heater; and an evaporator which is disposed on an outlet side of the expansion valve and which is disposed so that the refrigerant whose pressure has been lowered by the expansion valve evaporates to cool supply air in the supply air passage; and a sensible heat exchanger which allows supply air dehumidified by the dehumidifier to exchange sensible heat with exhaust air before flowing into the heater, the refrigerating device having a heat exchanger between an outlet side of the heater and an inlet side of the expansion valve, the heat exchanger being disposed on an outdoor side of the dehumidifier in the exhaust air passage.

5. The air conditioner according to any one of claims 1 to 4, further comprising: a circulation passage capable of circulating air in the room to the supply air passage, the supply air passage including: outside air introduced amount control means capable of controlling an amount of outside air to be introduced into the supply air passage; and circulation air amount control means capable of controlling an amount of air to be circulated from the circulation passage to the supply air passage, a connecting portion of the circulation passage to the supply air passage being disposed between the outside air introduced amount control means and the dehumidifier.

6. The air conditioner according to any one of claims 1 to 4, wherein carbon dioxide is used as the refrigerant of the refrigerating device.

7. The air conditioner according to claim 5, wherein carbon dioxide is used as the refrigerant of the refrigerating device.

* * * * *